US006327451B1

(12) United States Patent
Mizuno

(10) Patent No.: US 6,327,451 B1
(45) Date of Patent: Dec. 4, 2001

(54) DEVELOPMENT DEVICE FOR USE WITH AN ELECTROPHOTOGRAPHIC IMAGE-FORMING DEVICE

(75) Inventor: Tsuneo Mizuno, Kawasaki (JP)

(73) Assignee: Fujitsu, Ltd., Kawasaki (JP)

( * ) Notice: Subject to any disclaimer, the term of this patent is extended or adjusted under 35 U.S.C. 154(b) by 83 days.

(21) Appl. No.: 09/583,561

(22) Filed: May 31, 2000

(30) Foreign Application Priority Data

Oct. 18, 1999 (JP) ..... 11-295875

(51) Int. Cl.[7] ..... G03G 15/08
(52) U.S. Cl. ..... 399/281; 399/53; 399/283
(58) Field of Search ..... 399/53, 55, 56, 399/272, 273, 274, 281, 282, 283, 284, 285, 290, 291

(56) References Cited

FOREIGN PATENT DOCUMENTS 6-186832 7/1994 (JP) .

9-54496 2/1997 (JP) .

*Primary Examiner*—Arthur T. Grimley
*Assistant Examiner*—Hoang Ngo
(74) *Attorney, Agent, or Firm*—Armstrong, Westerman, Hattori, McLeland & Naughton, LLP

(57) ABSTRACT

It is an exemplified object of the present invention to provide a development device and process, and an electrophotographic image-forming device that can more stably supply toner to and collect the toner from a development roller, and charge the toner, and thus can obtain a higher-printing-quality image than was previously possible. To achieve this object, the toner supply and collection are carried out by electric force (potential difference) while preventing the toner from deteriorating by providing a gap between a reset roller and the development roller, whereby a high-quality image-forming is possible even when printing is performed for a long time. Excellency in uniformity of charge in the toner makes it possible to stabilize capability of supplying the toner and to improve image quality.

18 Claims, 8 Drawing Sheets

DEVELOPMENT DEVICE FOR USE WITH AN ELECTROPHOTOGRAPHIC IMAGE-FORMING DEVICE

BACKGROUND OF THE INVENTION

The present invention relates generally to image-forming devices, and more particularly to a development device for use with an electrophotographic image-forming device. The present invention is suitable, for example, for a development device for an electrophotographic recording device (or printer). The "electrophotographic recording device" by which we mean is a recording device employing the Carlson process described in U.S. Pat. No. 2,297,691, as typified by a laser printer, and denotes a nonimpact image-forming device that provides recording by depositing a developer as a recording material on a recordable medium (e.g., printing paper, and OHP film). The image-forming device of the present invention is broadly applicable not only to a discrete printer, but also to various apparatuses having a recording function such as a photocopier, a facsimile unit, a computer system, word processor, and a combination machine thereof.

With the recent development of office automation, the use of electrophotographic image-forming devices such as a laser printer for computer's output devices, facsimile units, photocopiers, etc. have spread steadily. Particularly, the electrophotographic printer as an example of the electrophotographic image-forming devices features good operability, usability for a wide range of media, high cost efficiency, and high printing quality, whereby a further improvement in high-quality and high-speed printability will be expected in future. The electrophotographic image-forming device generally includes a photoconductive insulator (photosensitive drum), and follows the procedural steps of charging, exposure to light, development, transfer, fixing, and other post-processes.

The charging step uniformly electrifies the photosensitive drum (e.g., at −600V). The exposure step irradiates a laser beam or the like on the photosensitive drum, and changes the electrical potential at the irradiated area down, for example, to −50 V or so, forming an electrostatic latent image. The development step electrically deposits a developer onto the photosensitive drum using, for example, the reversal process, and visualizes the electrostatic latent image. The reversal process is a development method that forms an electric field by a development bias in areas where electric charge is eliminated by exposure to light, and deposits the developer having the same polarity as uniformly charged areas on the photosensitive drum by the electric field. The transfer step forms a toner image corresponding to the electrostatic latent image on a recordable medium. The fixing step fuses and fixes the toner image on the medium using heat, pressure or the like, thereby obtaining a printed matter. The post-processes may include charge neutralization and cleaning on the photosensitive drum from which toner has been transferred out, a collection and recycle and/or disposal of residual toner, etc.

The developer for use with the aforementioned development step can be broadly divided into a monocomponent developer using toner and a dual-component developer using toner and a carrier. The toner may use a particle prepared, for example, in such a manner that a colorant such as a dye and a carbon black, or the like is dispersed in a binder resin made of synthetic macromolecular compound, and then is ground into a fine powder of approximately 3 through 15 $\mu$m. A usable carrier may include, for example, an iron powder or ferrite bead of approximately 100 $\mu$m in diameter. The monocomponent developer advantageously results in (1) simple and miniature equipment due to eliminating a carrier deterioration, a toner density control, mixing, and agitation mechanisms, and (2) used toner without any waste such as a carrier.

The monocomponent developer may be further classified into a magnetic monocomponent developer that includes toner in a magnetic powder, and nonmagnetic monocomponent developer that does not include the same. However, the magnetic monocomponent developer is disadvantageous in (1) the low transfer performance due to the high content of low electrical resistant magnetic powder which hinders the increased electric charge amount, (2) the bad colorization due to its low transparent, black-color magnetic powder; (3) the low fixing performance due to the magnetic powder which requires high temperature and/or high pressure, increasing a running cost. Accordingly, the nonmagnetic monocomponent developer without these disadvantages is expected to be in increasing demand in future.

The nonmagnetic monocomponent developer commonly uses the toner having a relatively high volume resistivity (e.g., at 300 G Ω·cm, etc.). In addition, the toner, as basically carries no electric charge, needs to be charged by the triboelectricity or charge injection in the development device.

The development process employing the nonmagnetic monocomponent developer is divided into contact- and noncontact-type development processes: The contact-type development process deposits a developer on the photosensitive drum by bringing the development roller carrying the developer into contact with the photosensitive drum; and the noncontact-type development process (as may be called jumping development process) providing a certain gap (e.g., of about 350 $\mu$m) between the development roller and the photosensitive drum to space them from each other, and flies the developer from the development roller to and deposits the same onto the photosensitive drum. Disadvantageously, the contact-type development process may deteriorate the developer by friction between the development roller and the photosensitive drum, and besides cause a crack of the photosensitive film, shortening the life of photosensitive body. Accordingly, the noncontact-type development process without these deteriorations has recently been highlighted.

It is significant for the noncontact-type development process employing the nonmagnetic monocomponent developer to ensure a sufficient image density by controlling the amount of toner flying from the development roller to the photosensitive drum. Thus, it is very important to form a toner thin layer while controlling its thickness on the development roller. As a typical method for regulating a toner layer thickness of toner, it has conventionally been proposed to provide an elastic blade (restriction blade) in contact with the development roller to maintain the layer thickness uniform.

The noncontact-type development device 100*a* employing the typical nonmagnetic monocomponent developer, as shown in FIG. 12, generally comprises a reset roller 10*a*, a development roller 20*a*, and a blade 30*a*. The development roller 20*a* and the reset roller 10*a* are connected with a bias power supply, and the development bias is applied from the bias power supply 50*a* to the development roller 20*a* by superposed AC voltage 54*a* and DC voltage 52*a*. The reset roller 10*a*, which is also called supply roller or application roller, contacts the development roller 20*a* and serves not only to supply toner T to the development roller 20*a*, but also to scrape off and remove the toner T unused for the development and remaining on the development roller 20*a*.

To be more specific, the reset roller 10*a*, which is typically made of an elastic member such as urethane foam, comes in contact with and is engaged in the development roller 20*a* to the depth of 0.2 through 0.5 mm, and rotates against the direction of rotation of the development roller 20*a*. The development roller 20*a*, which is, for example, a roller made of metal such as aluminum, adsorbs the charged toner on its surface in the form of the thin layer, and conveys it to a development area.

The blade 30*a* is brought into contact with the development roller 20*a* and serves to regulate the toner layer to a uniform thickness. The blade 30*a* may be made up of one elastic member such as urethane, or of a metal member having a contact portion made of resin with the development roller 20*a*. For instance, according to Japanese Patent Applications Laid-Open Nos. 8-202130 and 6-102748, when a metal member, namely rigid member, is used for the development roller 20*a*, the toner layer may be regulated by bringing a blade 30*a* made of an elastic body such as rubber into contact with the development roller; on the other hand, when a member made of an elastic body such as rubber is used for a surface of the development roller 20*a*, the toner layer may be regulated by bringing an end portion or non-end portion (namely midsection) of the blade 30*a* into contact with the development roller 20*a*. In order to avoid damaging the development roller 20*a* and the blade 30*a* by mitigating the accuracy in contact pressure required at the contact potion between them, these prior arts have devised to use a contact between one that is rigid and the other that is elastic. The Japanese Patent Applications Laid-Open Nos. 8-202130 and 6-102748 also disclose a surface roughness of the development roller 20*a*, a pressure with which the blade 30*a* is pressed against the development roller (blade pressure), a toner particle diameter, and other conditions for forming a toner layer.

In operation, the toner T is charged (e.g., negatively) by sliding friction among the reset roller 10*a*, the blade 30*a*, and the development roller 20*a*. The negatively charged toner T thereafter is fed onto a surface of the development roller 20*a* by the reset roller 10*a*, and deposited thereon by electrostatic adsorption. Subsequently, the toner layer on the development roller 20*a* is leveled by the blade 30*a* to form a thin layer having a uniform thickness of about 10 $\mu$m through 40 $\mu$m. The toner T, which has been conveyed to a development area where a surface of the development roller 20*a* is closest to the photosensitive drum 210*a*, flies and adhered to an electrostatic latent image on the photosensitive drum 210*a* with the electrical force of attraction using a predetermined voltage applied to the development area. Consequently, the latent image is visualized and developed. Next, the reset roller 10*a* removes the residual toner on the development roller 20*a* that is left in a no-image area where no latent image is formed. The development process repeats a series of these operations.

However, since a voltage having the same waveform as the development roller 20*a* is applied to the reset roller 10*a* by the development bias power supply 50*a*, a toner supply from the reset roller 10*a* to the development roller 20*a* varies with areas on the development roller 20*a* according to whether the areas were used last time for development on the photosensitive drum 210*a*, and would disadvantageously produce a so-called incidental image. The incidental image would disadvantageously cause an insufficient supply of the toner T to the development roller 20*a*, leading to a lack of density in areas once used when the same areas are used for the second or third time.

The toner T remaining in unused area increases in charge amount by passing under the blade more then once, and thus may disadvantageously lower the density due to the reduced amount of development in that area. Decrease in performance of collecting the residual toner T by the reset roller 10*a* is, as pointed out in Japanese Patent Application Laid-Open No. 9-54496, derived from increase in apparent rigidity due to cumulative clogs of the toner T into the urethane foam.

Moreover, the residual toner would disadvantageously film the development roller 20*a*, or adhere to the brush 30*a*. Filming is a phenomenon in which part of the toner T is deposited onto the development roller 20*a* by the frictional heat, mechanical crushing force, or electrostatic force that generates by the friction between a surface of the development roller 20*a* and the toner T.

As a result, the toner layer having a uniform thickness and charge amount cannot be formed on the development roller 20*a*, lowering the development performance.

In order to eliminate these disadvantages, it is conceivable to adopt a method of collecting the toner in full by deepening the contact between the development roller 20*a* and the reset roller 10*a* to facilitate mechanically scraping off the toner T. However, this method may increase a contact pressure between the development roller 20*a* and the reset roller 10*a*, and disadvantageously increase torque, crush the toner T by a repeated use, and degrade properties of the toner T by embedding external additives (e.g., silica) in the toner T. The toner T, if degraded, would reduce its fluidity and become coagulated, and thus disadvantageously be prevented from flying to the photosensitive drum, or allowed to fly in the form of lumps, deteriorating its printing quality, and particularly, its resolution.

BRIEF SUMMARY OF THE INVENTION

Accordingly, it is an exemplified general object of the present invention to provide a novel and useful development device and process, and electrophotographic image-forming device, in which the above disadvantages are eliminated.

Another exemplified and more specific object of the present invention is to provide a development device and process, and electrophotographic image-forming device that may stably supply toner to a development roller and charge toner, providing high-quality printed images.

In order to achieve the above objects, a development device as one exemplified embodiment of the present invention comprises a development roller which receives a voltage having an AC waveform including an offset voltage $V_{off}$ and a peak-to-peak voltage $V_{p\text{-}p}$ and conveys a developer to a development area, a reset roller spaced apart from the development roller by a gap g, said reset roller receiving a DC voltage $V_r$, supplying the developer to the development roller, and collecting a residual developer, and a blade that comes into contact with the development roller, and can form a uniform layer of the developer on the development roller, wherein the gap g between the development roller and the reset roller satisfies $0\ \text{mm} \leqq g \leqq 0.4\ \text{mm}$. According to this development device, no contact between the reset roller and the development roller can prevent the developer from deteriorating, and reduce an occurrence of fogs or the like, forming high-resolution images.

A development process as an exemplified one embodiment of the present invention comprises the steps of supplying a developer from a reset roller to which a DC voltage $V_r$ is applied, to a development roller to which a voltage having an AC waveform including an offset voltage $V_{off}$ and a peak-to-peak voltage $V_{p-p}$ is applied, by utilizing a potential difference between the reset roller and the development roller spaced apart from the reset roller by a gap g, forming a uniform layer of the developer on the development roller by bringing a blade into contact with the development roller, flying the developer from the development roller spaced apart from a photosensitive body, to the photosensitive drum so as to visualize images thereon, and collecting a residual developer remaining on the development roller utilizing the potential difference and the reset roller, wherein g, $V_r$, $V_{off}$, and $V_{p-p}$ satisfy 0 mm$\leqq$g$\leqq$0.4 mm, and $|V_{off}|+V_{p-p}/2>|V_r|\geqq|V_{off}|$. Notwithstanding no contact between the reset roller and the development roller, this development process can supply a developer by electric force caused by a different voltage applied to each roller.

A developer conveyance method as one exemplified embodiment of the present invention comprises the steps of charging an uncharged developer with a DC voltage $V_r$ applied to a reset roller, supplying the developer to a development roller which receives a voltage having an AC waveform including an offset voltage $V_{off}$ and a peak-to-peak voltage $V_{p-p}$, and is spaced apart from the reset roller by a gap g; collecting the developer remaining on said development roller by using the reset roller, wherein a voltage applied to said development roller is $V_{p-p}/2+|V_{off}|-|V_r|$ in the supplying step, and $V_{p-p}/2-|V_{off}|+|V_r|$ in the collecting step. This developer conveyance method may sufficiently provide a uniform toner charging, and supply and collect the developer, since an AC voltage applied to the developer does not cause any stress on the developer, thus reducing image deterioration even after a long-term printing.

An image-forming device as one exemplified embodiment of the present invention comprises a photosensitive body, a charger that charges said photosensitive body, an exposure section that exposes said photosensitive drum charged by said charger, and forms an electrostatic latent image, a development device that develops said exposed photosensitive drum, and visualizes said electrostatic latent image as a toner image, and a transfer section that transfers said toner image onto a recordable medium, wherein said development device comprises a development roller which receives a voltage having an AC waveform including an offset voltage $V_{off}$ and a peak-to-peak voltage $V_{p-p}$ , and conveys a developer to a development area, a reset roller spaced apart from the development roller at a gap g, the reset roller receiving a DC voltage $V_r$, supplying the developer to the development roller, and collecting a residual developer, and a blade that comes into contact with the development roller, and can form a uniform layer of the developer on the development roller, wherein g, $V_r$, $V_{off}$, and $V_{p-p}$ satisfy 0 mm$\leqq$g$\leqq$0.4 mm, and $|V_{off}|+V_{p-p}/2>|V_r|\geqq|V_{off}|$. This image-forming device can stably supply the developer to the development roller, and uniformly charge the developer, providing high-quality images.

Other objects and further features of the present invention will become readily apparent from the following description of the embodiments with reference to accompanying drawings.

DETAILED DESCRIPTION OF THE INVENTION

Figure 1:
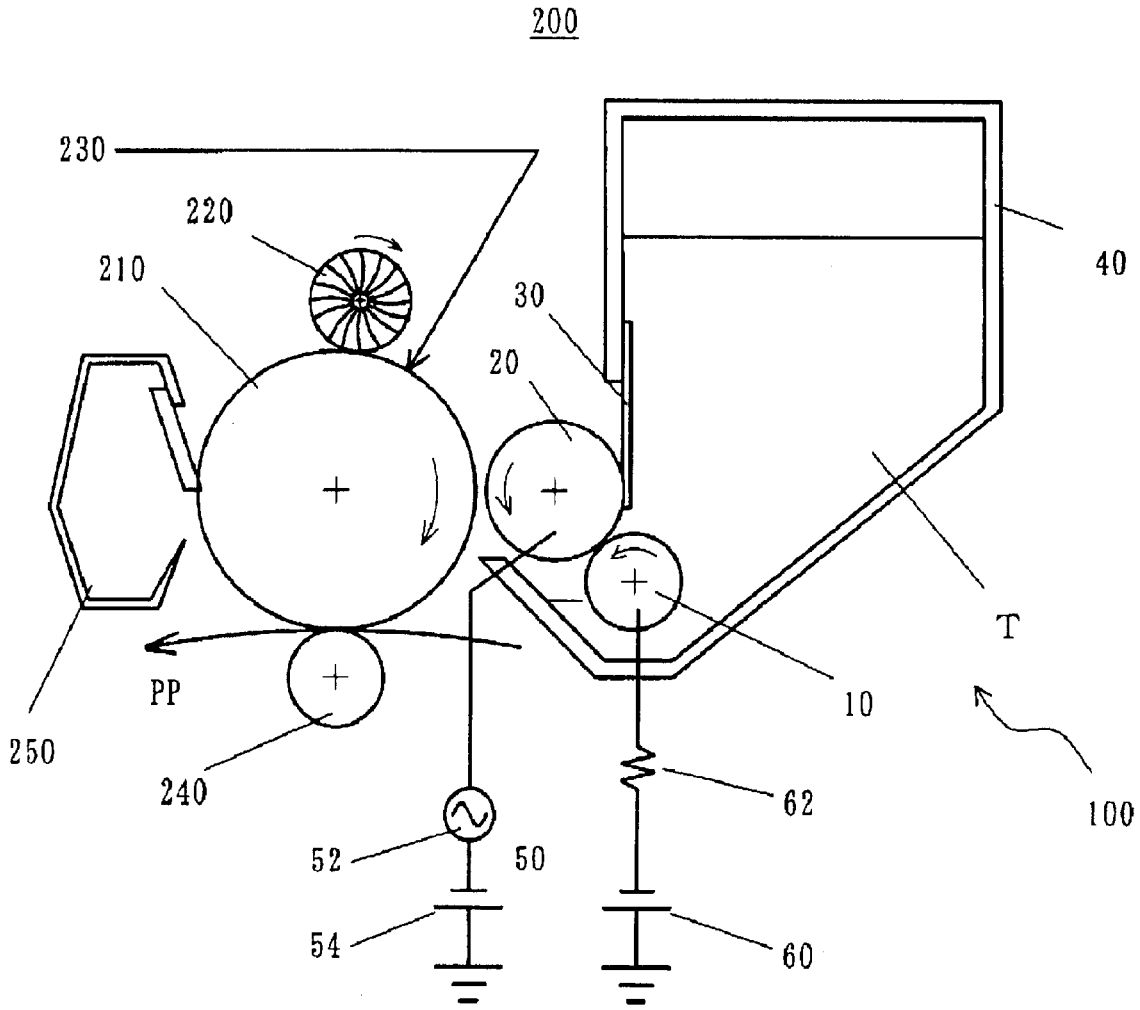
FIG. 1 is a schematic sectional view of a principal part of a development device 100 and an image-forming device 200 including the development device 100 as one exemplified embodiment of the present invention.

A description will now be given of a development device 100 and an image-forming device 200 having the development device 100 with reference to FIG. 1. In each figure, those elements designated by the same reference numerals denote the same elements, and a duplicate description thereof will be omitted. Hereupon, FIG. 1 is a schematic sectional view of a principal part of the image-forming device 200 including the development device 100 as one exemplified embodiment of the present invention. The development device 100 includes a reset roller 10, a development roller 20, a blade 30, a frame 40, a development bias power supply 50, and a development auxiliary power supply 60. A detailed description will also be given of a structure and operation process of the development device 100 with reference to FIG. 2, which is a sectional view of a principal part of the development device 100 as one exemplified embodiment of the present invention.

Figure 2:
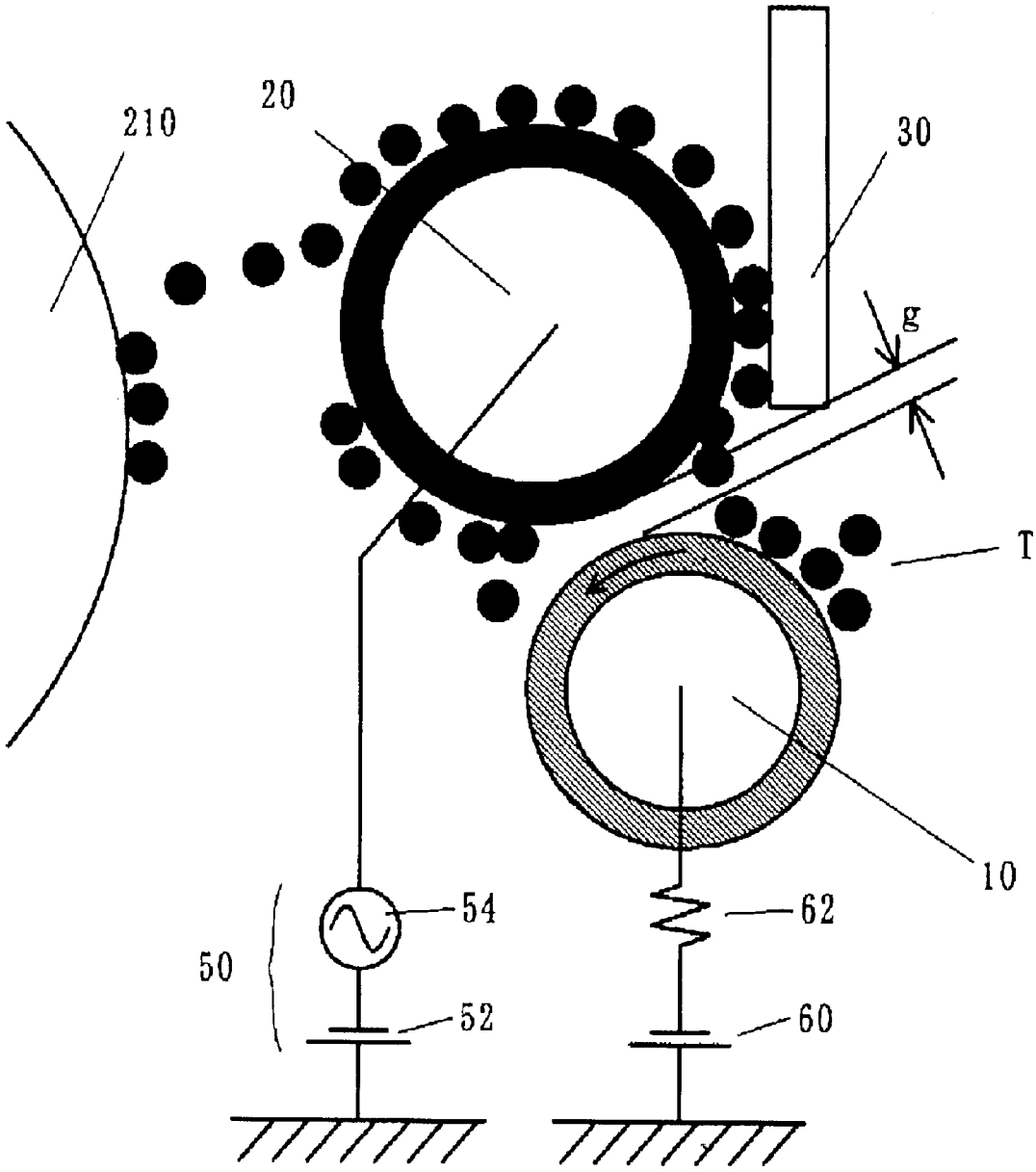
FIG. 2 is a magnified sectional view of a principal part of the development device 100 shown in FIG. 1.

The reset roller 10, which is also called a supply roller or application roller, supplies a toner T stored in the frame 40 to the development roller 20. The reset roller's capability of supplying the toner T depends to a large extent upon its mechanical conveyance capability as well as electrical supply capability, and thus is preferably made of a spongy material. The reset roller 10 may also serve to collect the residual toner T unused for the development and left on the development roller 20. In the present embodiment as shown in FIG. 2, the reset roller 10 rotates to the left (counterclockwise), and is located near the development roller 20 with a spacing ranging from 0 mm through 0.4 mm. This configuration may prevent the toner T from crashing by friction with the reset roller 10 and the development roller 20. To the reset roller 10 an DC voltage is applied by a development auxiliary power supply 60, and the applied voltage can be changed. Changing the applied voltage makes it possible to achieve a supply and collection of the toner T to the development roller 20.

The development roller 20 adsorbs the toner T on its surface, and, as rotating, conveys the toner T to the development area. The development area is an area where the photosensitive roller 210 and the development roller 20, which will be explained later, are set closest together. The development roller 20, for instance, rotates at the same speed and in the same direction (counterclockwise in the present invention) as the photosensitive drum 210. A usable material for the development roller 20 may include metal such as aluminum and stainless steel, and electrically conductive rubber. An application of a DC voltage generated by superposing a DC voltage on an AC voltage by the development bias power supply 50 to these electroconductive materials allows to generate electrostatic adsorption and adsorb the toner T.

Figure 3:
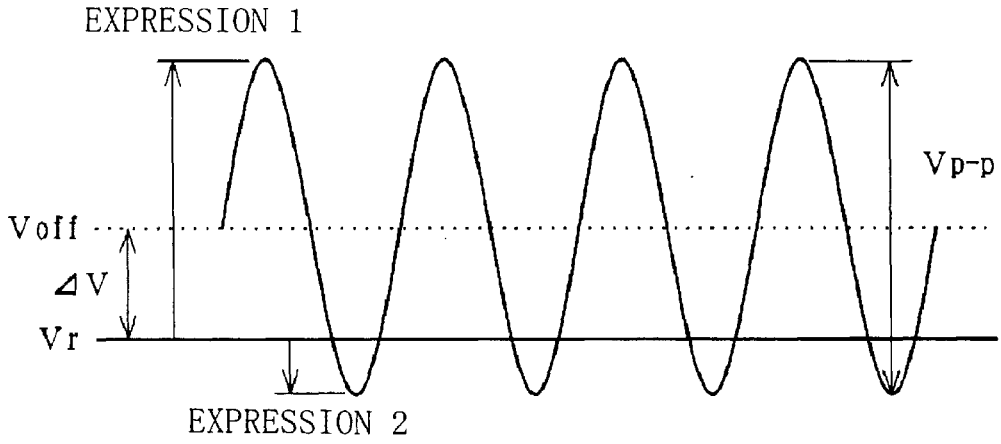
FIG. 3 is a diagrammatic illustration for explaining changes in voltage applied to toner T.

In the present embodiment, as described above, the reset roller 10 and the development roller 20 are charged by voltages applied to each of them, and electric force thereof are used to supply and collect the toner T. Where a voltage applied to the reset roller 10 is $V_r$, a voltage applied to the development roller 20 as an offset voltage (DC voltage) is $V_{off}$, and a peak-to-peak voltage ($AC_{p-p}$; AC voltage) as an amplitude (voltage difference between maximum and minimum) of an AC voltage is $V_{p-p}$, voltages given by the following expressions 1 and 2 are repeatedly applied. Referring to FIG. 3, a description will be given of a displacement of the voltage applied to the toner T.

$$V_{p-p}/2+|V_{off}|-|V_r| \quad (1)$$

$$V_{p-p}/2-|V_{off}|+|V_r| \quad (2)$$

The expression 1 denotes a voltage when the toner T is supplied from the reset roller 10 to the development roller 20. A surface of the reset roller 10 exhibits a voltage $V_r$, as shown in FIG. 3, and thus the toner T on the roller 10 exhibits the same voltage $V_r$. On the other hand, a surface of the development roller 20 exhibits a voltage indicated by $V_{p-p}/2+|V_{off}|$, which is a higher potential in comparison with $V_r$. Accordingly, the toner T is adsorbed onto the development roller 20 having a higher potential, and thus an application of the voltage worked out by the expression 1 is carried out in supplying the toner T.

The expression 2 denotes the voltage at which the toner T is collected from the development roller 20. Relative to the voltage $V_r$, as explained above regarding the expression 1, a surface of the development roller 20 exhibits a voltage indicated by $V_{p-p}/2-|V_{off}|$, which is a lower potential than the $V_r$, as shown in FIG. 3. Accordingly, an application of the voltage worked out by the expression 2 is carried out in collecting the toner T, as the toner T is adsorbed onto the reset roller 10 having a higher potential.

Normally, $|V_r|$ is set higher than $|V_{off}|$, and thus the capability of supplying the toner T as shown in the expression 1 is larger than the capability of collecting the toner T as shown in the expression 2. Therefore, the development device 100 of the present invention follows a cycle of supplies and collections of the toner T electrically and repeatedly, and thus works with a greater efficiency than any conventional devices. In addition, the development process of the present invention includes the step of charging the toner T positively and negatively (i.e., AC charging), and thus can uniformly charge the toner T, regardless of whether it is reused or unused toner. Further the inventive development process has an excellent supply capability. Consequently, this process never produces an incident image phenomenon.

The blade 30 is a member serving to restrict to a predetermined thickness the toner T supplied by the reset roller 10, and is made of an elastic body typified by urethane, etc., or metal having leaf spring properties such as stainless steel and bronze. A method of regulating the toner layer varies with these materials and includes scraping and pressing.

The frame 40 stores the toner T, supplies the same to the reset roller 10, and receives the toner T collected by the reset roller 10. The frame 40 includes a puddle, an agitator, and other components (not shown), and is connectible with an external toner storage container such as a toner cartridge.

The bias power supply 50 includes superposed AC/DC power supplies: the AC power supply 52 for an offset voltage, and the DC power supply 54 for a peak-to-peak voltage. The development auxiliary power supply 60 is a DC power supply, and a compensating resistor is provided in series with the power supply 60 between the power supply 60 and the reset roller 10.

The toner T is a kind of the monocomponent developers, which is one of two categories of the developer, and the other is the dual-component developer employing the toner T and a carrier. The monocomponent developer may be further classified into a magnetic monocomponent developer that includes toner in a magnetic powder, and a nonmagnetic monocomponent developer that does not include the same. The nonmagnetic monocomponent developer advantageously features: due to its monocomponent property, (1) simple and miniature development equipment due eliminating a carrier deterioration, toner density control, mixing, and agitation mechanisms, (2) used toner T without any waste such as a carrier, and due to its nonmagnetic property, (3) high transfer performance due to high electric charge amount, (4) fitness for colorization due to its high transparency, and others.

The toner T employed in the present embodiment, which is the nonmagnetic monocomponent developer, basically bears no charge as is the case with the toner T in general, and thus needs to be electrified by means of frictional charging, transfusing a charge from outside, or the like in the development device 100. The toner T to be used may be prepared, for example, by dispersing a colorant such as a dye and a carbon black, or the like in a binder resin made of a synthetic macromolecular compound, and then grinding the product into a fine powder of approximately 3 through 15 $\mu$m.

The image-forming device 200 as one exemplified embodiment of the present invention, as shown in FIG. 1, includes a photosensitive drum 210, a pre-charger 220, an exposure section 230, and a transfer roller 240. The photosensitive drum 210 includes a photosensitive dielectric layer on a rotatable drum-shaped conductor support, and is uniformly charged by the charger 220. The photosensitive drum 210 is, for instance, made of an OPC, amorphous Se, amorphous Si, or the like to which a function separation-type organic photoreceptor with a thickness of about 20 $\mu$m is applied on a drum-shaped aluminum member, has an outer diameter of 30 mm, and rotates at a circumferential velocity of 90 mm/s in the arrow direction.

The pre-charger 220, which is, for instance, a brush roller charger, uniformly charges a surface of the photosensitive drum 210 at about −600V. Next, a laser light corresponding to a print signal forms an image on the photosensitive drum 210 by the exposure section 230. The photosensitive drum 210 is uniformly charged then, and its uniform potential are partly eliminated, so that areas in which an image is formed by the light may be neutralized (e.g., −50V) due to the effects of the above photosensitive dielectric layer, forming a latent image of charge patterns corresponding to light and dark patterns on the original document. The latent image is visualized into a toner image by the development device 100.

In the development device 100, the development roller 20 located close to the photosensitive drum 210 rotates at the same circumferential velocity as and in the direction opposite to the photosensitive drum 210, and a toner layer is formed on the development roller 20 while the blade 30 regulates the toner T supplied from the reset roller 10 utilizing a potential difference. As described in the above paragraphs for explaining some embodiments, the development device 100 as one exemplified aspect of the present embodiment can stably supply the toner T onto the development roller 20, and the toner T is negatively charged by a voltage applied to the reset roller 10 and the development roller 20.

Subsequently, the toner layer formed on the development roller 20 flies and gets adsorbed onto the photosensitive drum by a development bias voltage applied to the development roller 20 by the development bias power supply 50, whereby the photosensitive drum 210 is developed.

The toner T unused for development is collected utilizing a potential difference by the reset roller 10 rotating below the development roller 20 in the same direction, passes through a lower portion of the reset roller 10, and returns into the frame 40. The toner image on the photosensitive drum 210 as obtained in this manner is transferred in a position near the transfer roller 240 onto a sheet of printing paper that is timely conveyed along a paper-conveying path PP by a conveyance roller (not shown). The residual toner T remaining on the photosensitive drum 210 is collected by a cleaner 250. The printing paper that has been printed passes through a fixing section, get fixed, and then dispensed out.

EXAMPLE

In the development device 100 as shown in FIG. 2, the following experiment was carried out to determine its development capability by varying development conditions such as voltages applied to the reset roller 10 and the development roller 20, and gaps between the reset roller 10 and the development roller 20.

A roller made of urethane resin foam of 1 MΩ was used for the reset roller 10, and a resistance of 10 MΩ was connected with the roller 10 in series. Two kinds of the development roller 20 were used: one was made of aluminum with a surface roughness of about 5 μm, and the other was made of NBR (nitrile rubber: elastic resistant body) of 10 kU. The surface of the photosensitive drum 210 was uniformly charged at −700V, and the gaps between the photosensitive drum 210 and the development roller 20 were kept at a constant value of 300 μm. The voltage $V_r$ applied to the reset roller 10 was varied from −400V to −1,400V. The voltage applied to the development roller 20 was set at −500V for an offset voltage $V_{off}$, and at 2,200V for a peak-to-peak voltage $V_{p-p}$, and a frequency of these voltages was 2 kHz (rectangular wave). The gap g between the reset roller 10 and the development roller 20 was varied from −0.2 mm to 1 mm.

Figure 4:
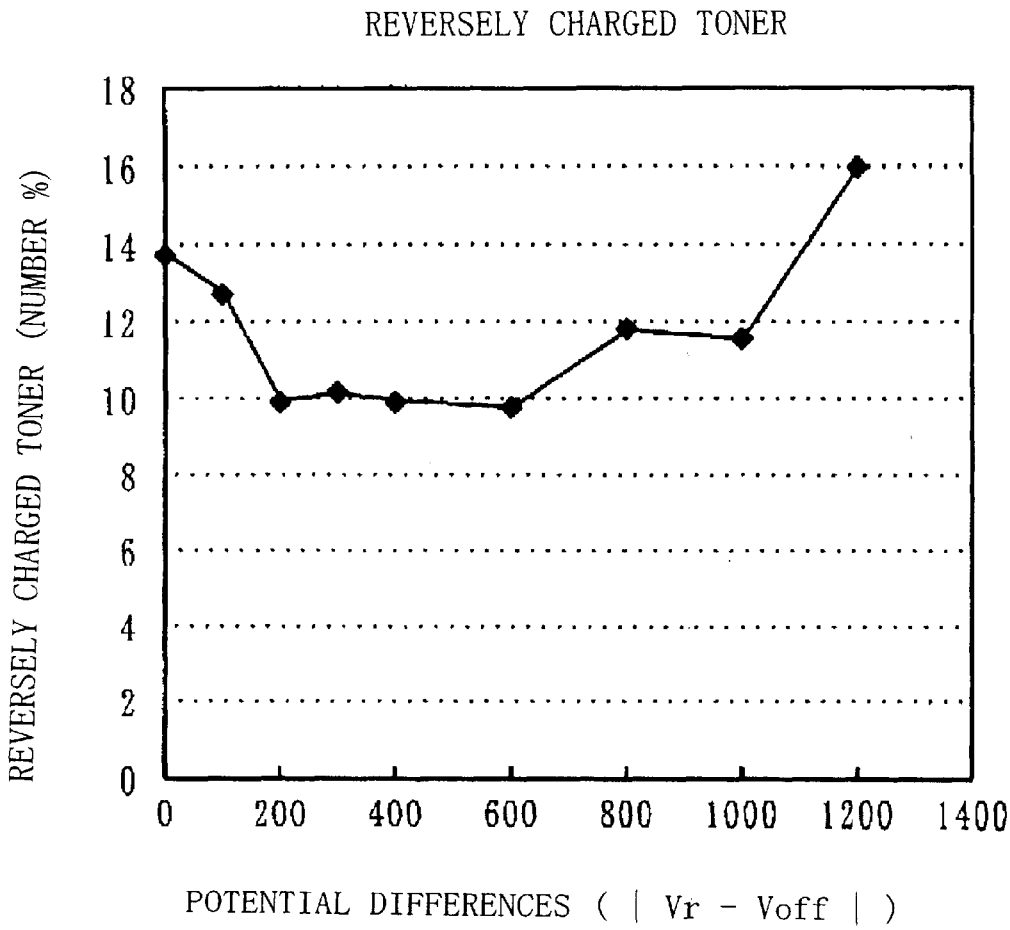
FIG. 4 is a diagram showing a relationship between potential differences ($|V_r-V_{off}|$) and amounts of reversely charged toner T in Experimental example 1.
Figure 5:
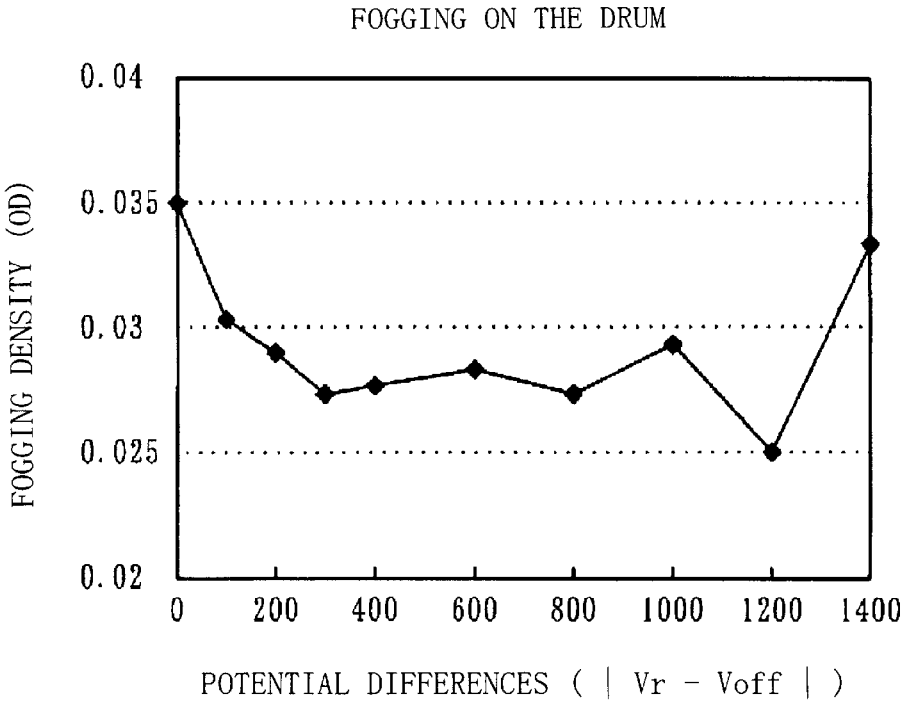
FIG. 5 is a diagram showing a relationship between potential differences and fogging on the drum in Experimental example 1.

In an experimental example 1, the development roller 20 made of aluminum was used, the gap g between the reset roller 10 and the development roller 20 was 0.2 mm, and the voltage $V_r$ applied to the reset roller 10 was varied from −500V to −1,700V. The development was carried out under such measuring conditions, and then the amount of reversely charged toner (number %) on the development roller 20, and A measurement was taken of the density of fogging generated on the photosensitive drum. Hereupon, the reversely charged toner means the toner T bearing charges of reverse polarity to a group of charges effective for development, and the fogging means a phenomenon of undesirably coloring with the toner T areas that have no image and thus is expected to be white clarity. The result is shown in FIGS. 4 and 5. FIG. 4 is a diagram showing a relationship between potential differences ($|V_r-V_{off}|$) and amounts of reversely charged toner T (number %). FIG. 5 is a diagram showing a relationship between potential differences and foggings on the drum 210. As shown in FIGS. 4 and 5, when the potential difference was set at 1,000V or less, the amount of reversely charged toner and the level of fogging generally exhibited constant values regardless of the potential differences, while on the other hand, when the potential difference was set at 1,200V or greater, they increased considerably. Accordingly, it is to be understood that it is preferable to set the potential differences of $V_r$ relative to $V_{off}$ at 1,200V or less, and the value $V_r$ should be smaller than the value of $|V_{off}|+V_{p-p}/2$.

Figure 6:
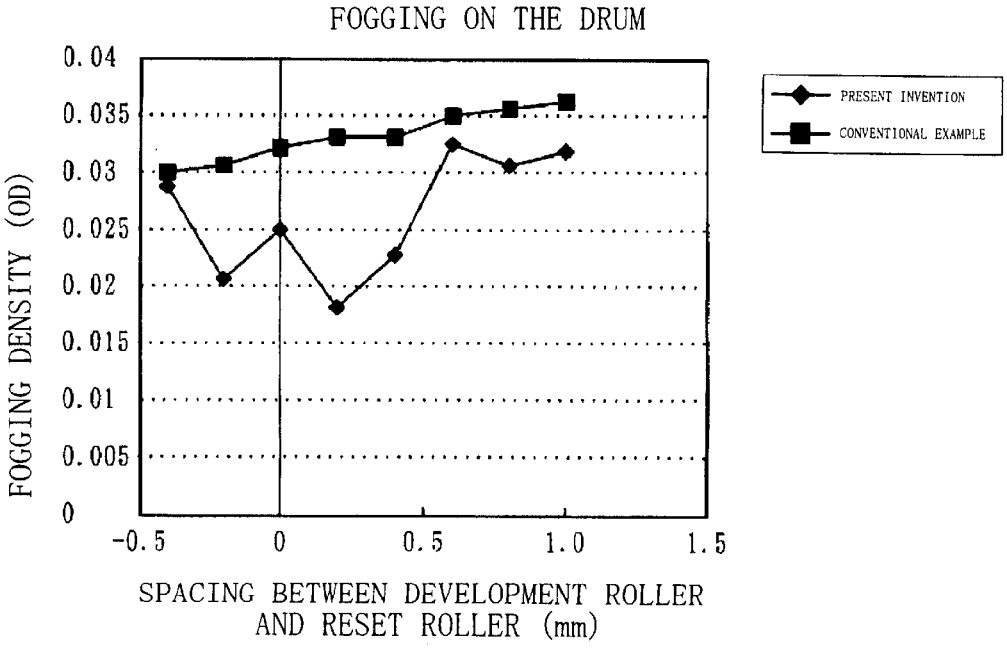
FIG. 6 is a diagram showing a relationship between a gap g and fogging density in Experimental example 2.

In an experimental example 2, the development roller 20 made of aluminum was used, the voltages was set so as to satisfy $V_{off}$=−500V, and $V_r$=−700V, the gap g was varied from −0.2 mm to 1 mm, and a measurement was taken of the fogging density. In contrast, the same experiment was carried out under the same conditions except that $V_r$ was equal to the voltage (development bias) applied to the development roller 20 as adopted by a conventional process. A diagram showing a relationship between the gap g and the fogging density based on the results is presented as FIG. 6. As shown in FIG. 6, as the gap g increases, the fogging density increases as well, according to the conventional process. However, it turned out that the gap g was kept at a constant value of 0.5 mm or larger, and the fogging density was at a constant value of 0.03 or smaller, according to the development process of the present invention.

Figure 7:
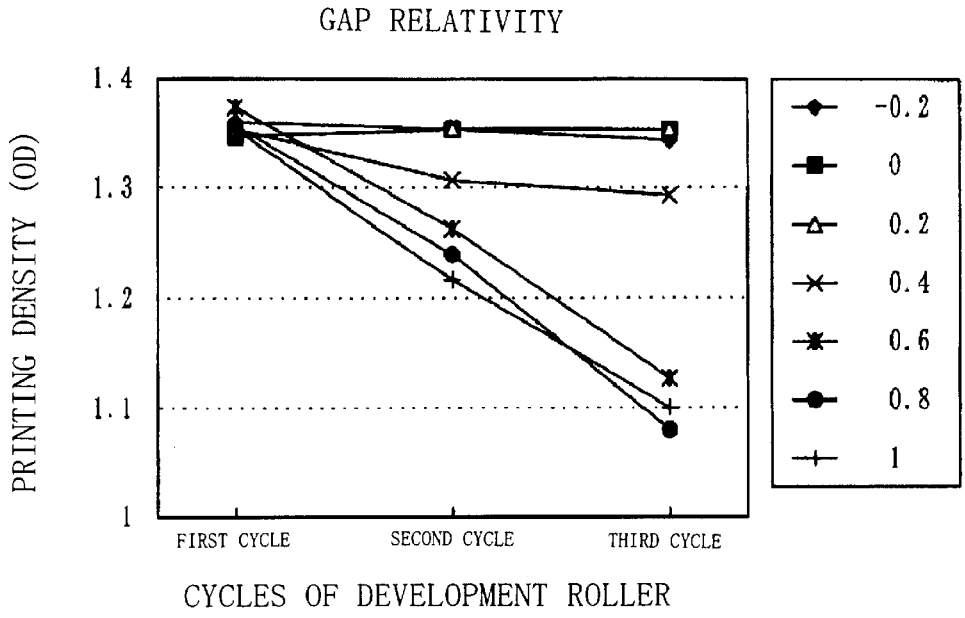
FIG. 7 is a diagram showing a relationship between a cycle of a development roller 20 and a printing density with respect to a gap g in Experimental example 3.
Figure 8:
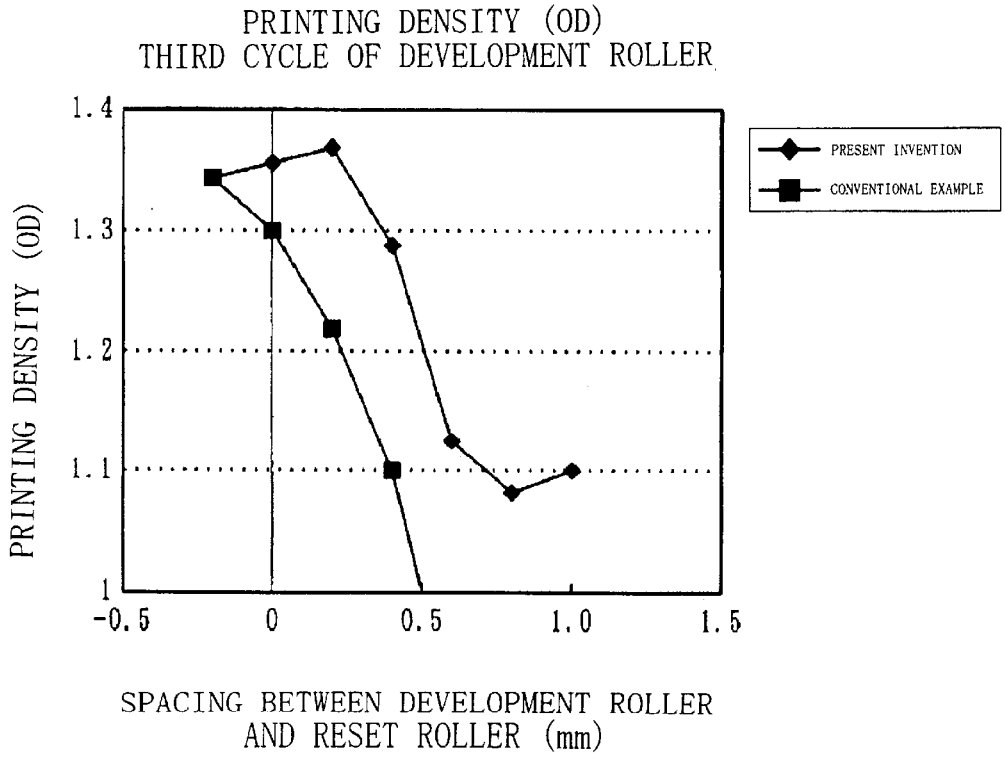
FIG. 8 is a diagram showing a relationship between a gap g of a third cycle of a development roller 20 and a printing density in Experimental example 3.

In an experimental example 3, the development roller 20 made of aluminum was used, the voltages were set so as to satisfy $V_{off}$=−500V and $V_r$=−700V, the gap g was varied from −0.2 mm to 1 mm, and a measurement was taken of a printing density. The printing density was measured by developing a filled-in image (such an image that a whole printable area is solidly filled). In contrast, as the above example 2, the same experiment was carried out under the same conditions except that the conventional process was applied. A diagram showing a relationship between a cycle of the development roller 20 and the printing density with respect to the gap g is presented as FIG. 7. A diagram showing a relationship between the gap g of the third cycle of the development roller 20, and the printing density is presented as FIG. 8. As shown in FIG. 7, it turned out that the printing density exhibited approximately a constant value regardless of the cycles of the development roller 20 if the gap g was set at 0.4 mm or smaller, and thus the supply of the toner T was sufficient. In the conventional process, as is evident from FIG. 8, it turned out that where the gap g widened over 0 mm so as to keep the rollers uncontacted, the supply of the toner T become short, and lowered the printing density. On the other hand, the process according to the present invention was able to provide a stable supply of the toner T where the gap g ranged between 0 mm through 0.5 mm even if the rollers were uncontacted, and to keep the printing density high. It has been suggested from the results shown in FIGS. 7 and 8 that the toner T may stably be supplied when the gap g is set at 0.4 mm or smaller.

Figure 9:
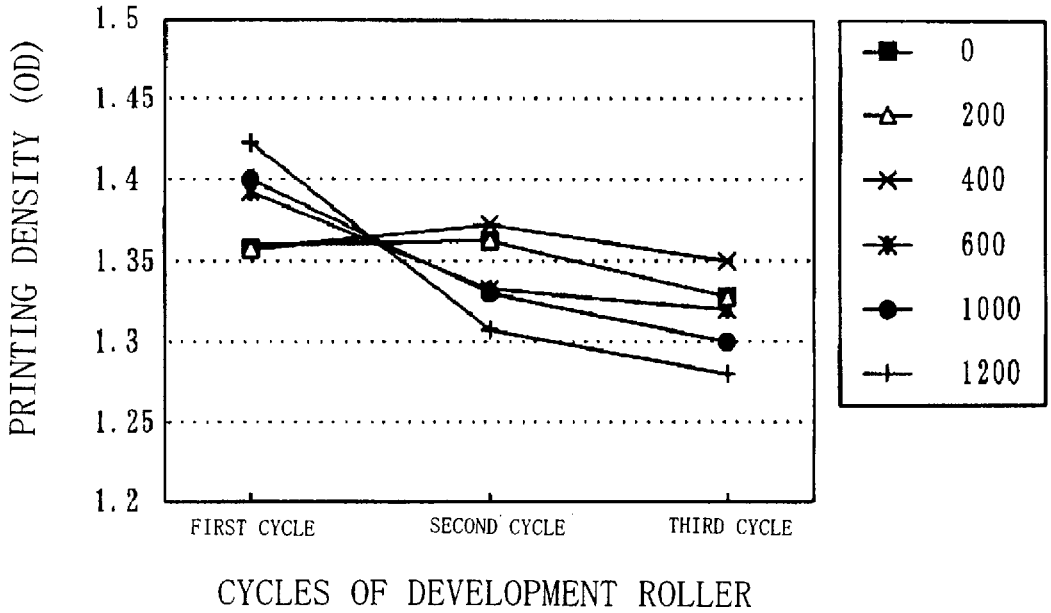
FIG. 9 is a diagram showing a relationship between a cycle of a development roller 20 and a printing density with respect to a voltage in Experimental example 4.
Figure 10:
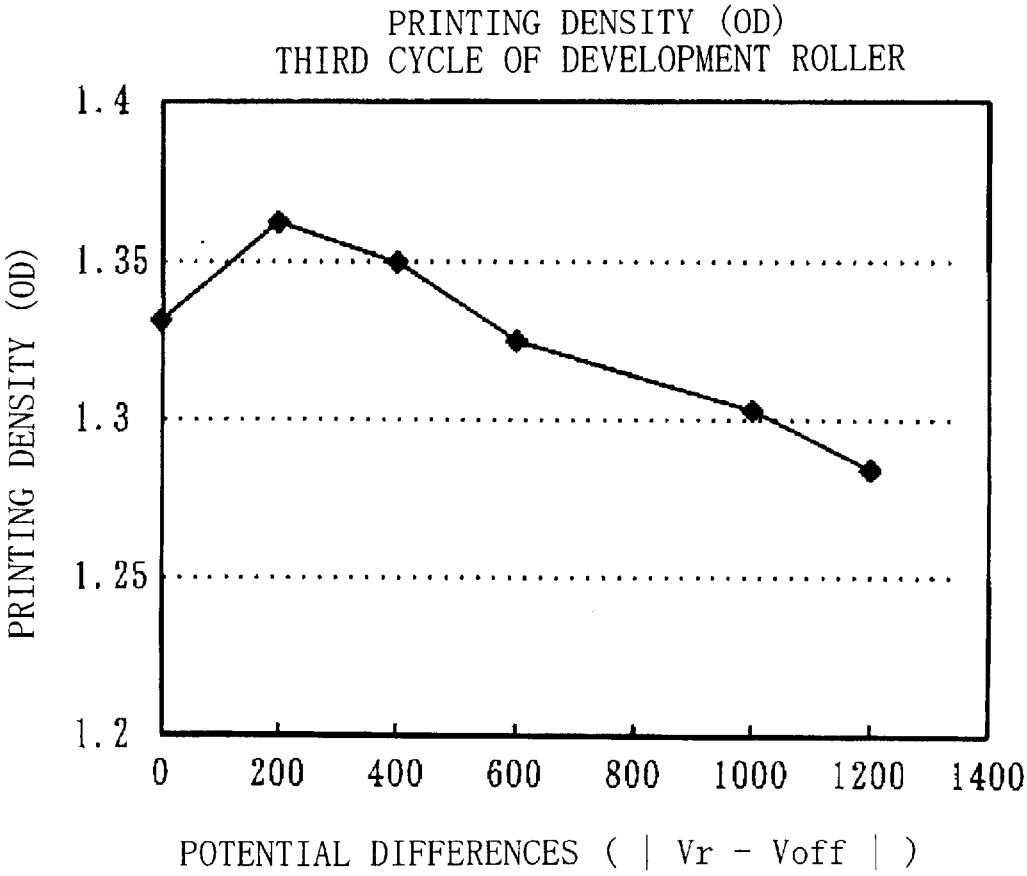
FIG. 10 is a diagram showing a relationship between a voltage of a third cycle of a development roller 20 and a printing density in Experimental example 4.

In an experimental example 4, the development roller 20 made of aluminum was used, the offset voltage was set so as to satisfy $V_{off}$=−500V, the gap g was set at 0.2 mm, the potential difference $|V_r-V_{off}|$ was varied from 0V to 1,200V, and a measurement was taken of a printing density in a filled-in image. A relationship between a cycle of the development roller 20 and a printing density with respect to potential differences are shown in FIG. 9. A relationship between a potential difference and a printing density with respect to the third cycle selected from the cycles of the development roller 20 are shown in FIG. 10. As shown in FIG. 9, the toner T was stably supplied regardless of the cycles of the development roller 20 if the potential difference was set at 200V and 400V, and thus good printing density could be maintained. As shown in FIG. 10, it turned out that when the potential difference was set at 400V or greater, the potential difference increased and the printing density decreased, and thus a too large amount of charge in the toner T would affect the printing performance.

Figure 11:
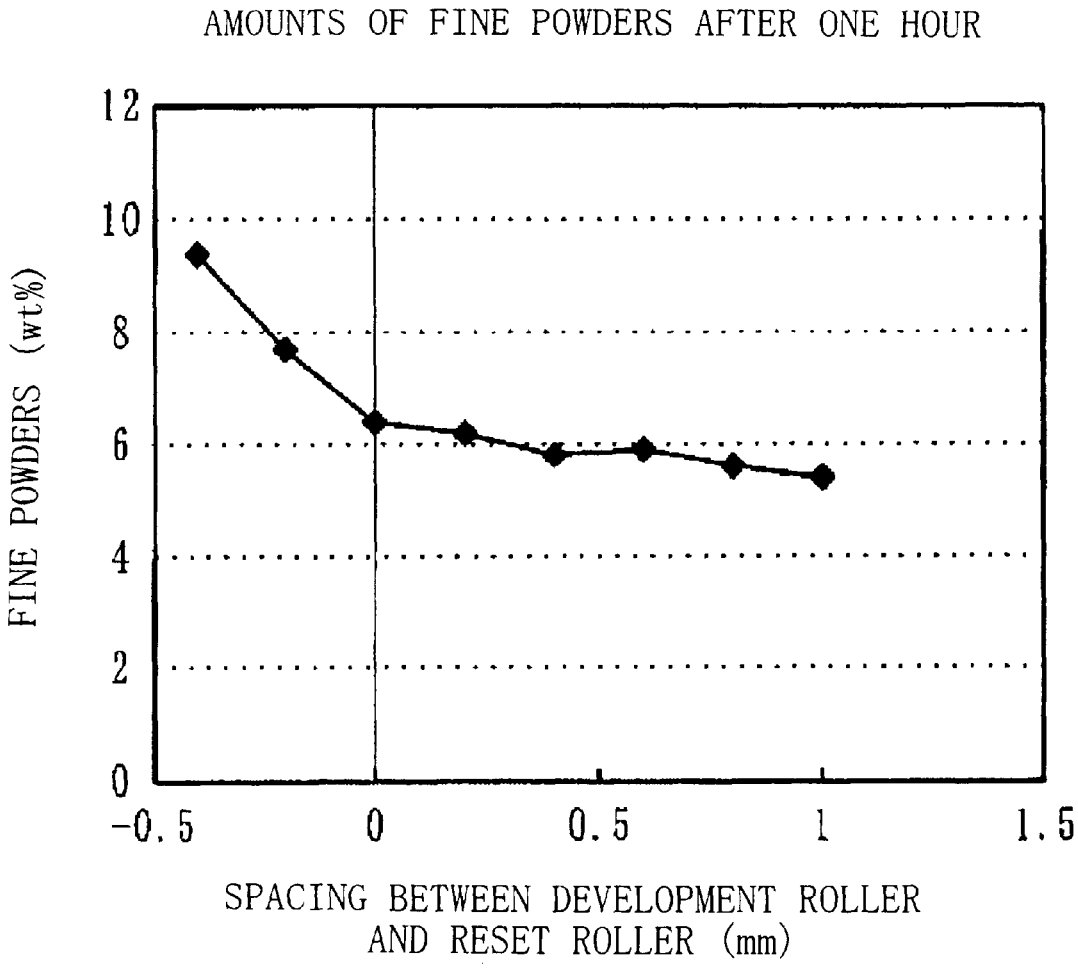
FIG. 11 is a diagram showing a relationship between a gap g and a fine powder amount (wt %) in Experimental example 5.
Figure 12:
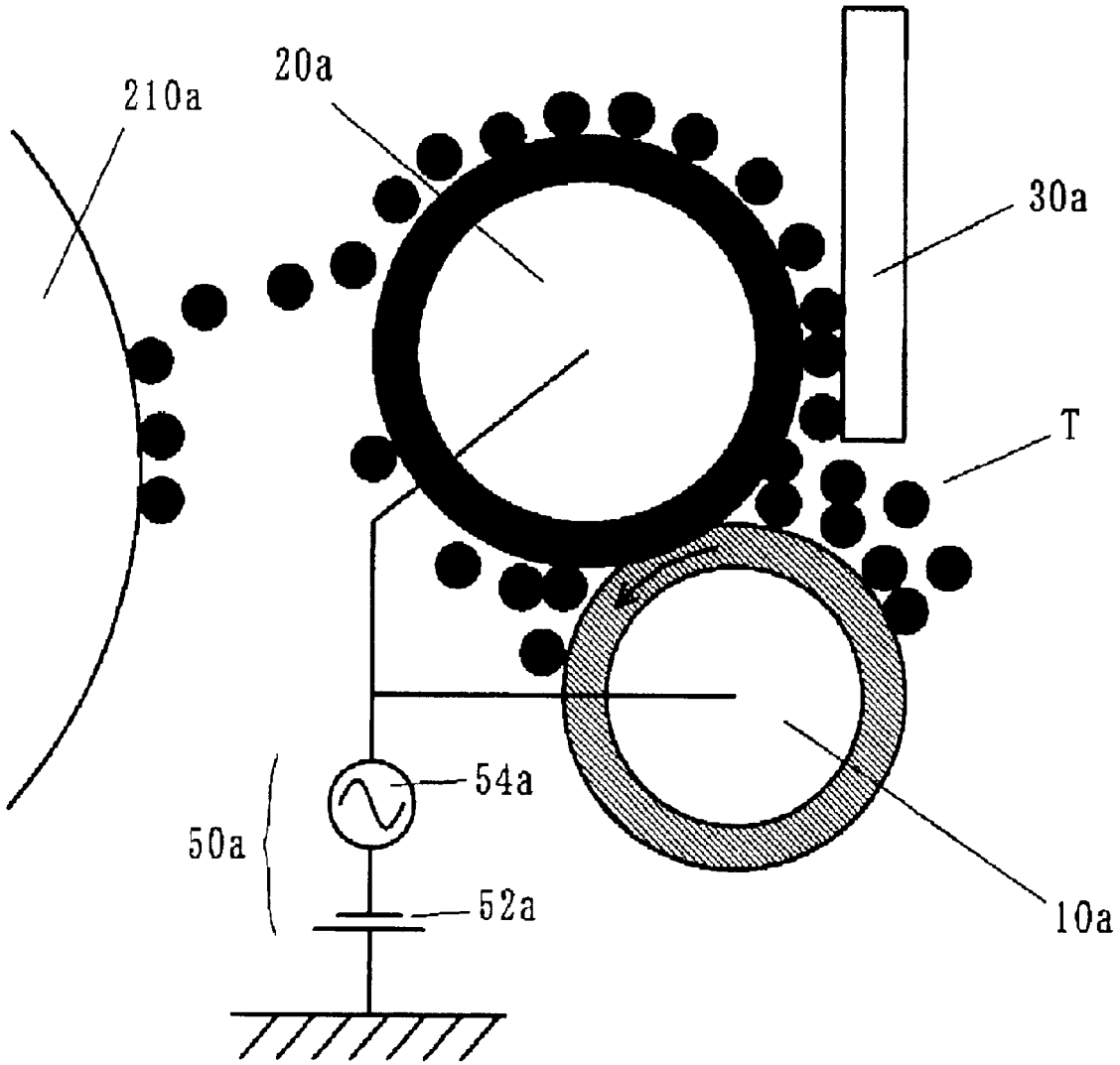
FIG. 12 PRIOR ART
FIG. 12 is a magnified sectional view of a principal part of a conventional development device 100*a*.

In the experimental example 5, the development roller 20 made of aluminum was used, the voltages were set so as to satisfy $V_{off}$=−500V and $V_r$=−700V, the gap g was varied from −0.2 mm to 1 mm, and a measurement was taken of an amount of fine powder (wt %). In this example, the amount of the fine powder was measured that was produced after one-hour operation of only the development device 100. Hereupon, the fine powder means a powder produced when the toner T is pulverized by the contact between the reset roller 10 and the development roller 20. FIG. 11 shows a relationship between the gap g and the amount of the fine powder (wt %). The amount of the fine powder was 4.2 wt % in an initial state of the experiment (early period of the rotation in the development device 100), and the fine powder production drastically increased where the gap g was 0 mm or smaller and the both rollers kept in contact with each other, as shown in FIG. 11. On the contrary, the fine powder was produced in comparison with the initial state of the experiment even where the rollers were in contact with each other, but the amount thereof exhibited a constant value regardless of the gap g.

According to the above-described experimental examples 1 through 5, it turned out that the gap g between the reset roller 10 and the development roller 20 would preferably range from 0 mm to 0.4 mm, and the printing performance was stable under such conditions.

Although the above experimental example adopted aluminum as a material of the development roller 20, the adoption of a rubber roller having a resistance of $10^6\Omega$ also brought the same results. However, a measurement was taken to determine a relationship between the cycles of the development roller 20 and the printing density under the conditions: the gap g=0.2 mm, $V_{off}$=−500V, $V_{p\text{-}p}$=2,200V, and $V_r$=−700V, and it turned out that the printing density decreased by about 0.2 at the third cycle of the development roller 20 where the rubber roller having the resistance over $10^7\Omega$ was used. This is because the failure to obtain effects of electrical interaction on the portion opposite to the reset roller 20 reduced the capability of supplying the toner T.

In order to obtain a good result as in the above experiments, a compensating resistance Rc needs to be interposed in series with the voltage $V_r$ applied to the reset roller 10; for a leak may occur between the voltage (AC+DC) applied to the development roller 20 and $V_r$ (DC). Where the compensating resistance Rc is $10^6\Omega$ or smaller, the voltage applied to the development roller flows into the voltage applied to the reset roller 10*a*, lowering its development performance. Where Rc is $10^8\Omega$ or larger, electrical effects are balanced out, and the effects of charges in the toner T are lost, thereby reducing the capability of supplying the toner T. Accordingly, the compensating resistance Rc preferably ranges from $10^6\Omega$ to $10^8\Omega$, and further preferably ranges from $5\times10^6\Omega$ to $5\times10^7\Omega$.

Considering a resistance in the reset roller 10 itself, electrical effects for keeping the printing performance stable may be obtained by ensuring a specific resistance value of $10^7\Omega\cdot$cm to the maximum. Particularly, since the capability of supplying the toner T requires an electrical supply capability and a mechanical conveyance capability, the reset roller 10 may be preferably made of a spongy material (urethane resin foam in the present embodiment) that offers advantages in conveyance capability, rather than materials having a smooth surface.

Although the preferred embodiments of the present invention have been described above, various modifications and changes may be made in the present invention without departing from the spirit and scope thereof.

As described above, according to the present invention, a gap is provided between the reset roller and the development roller, and toner is supplied by collected by electrical force (potential difference), while preventing the toner from deteriorating, whereby a higher-quality image can be formed even if a long-time printing is carried out, in comparison with a conventional development process.

The developer conveyance method according to the present invention allows the toner to be alternately charged positively and negatively by AC charging, and thus is excellent in providing a uniform charge of the toner. Accordingly, even if the reset roller and the development roller is not in contact with each other, a stable toner supply, a uniform toner charge and thus an improved image quality may be achieved.

What is claimed is:

1. A development device comprising:

a development roller which receives a voltage having an AC waveform including an offset voltage $V_{off}$ and a peak-to-peak voltage $V_{p\text{-}p}$ and conveys a developer to a development area;

a rest roller spaced apart from said development roller by a gap g, said rest roller receiving a DC voltage $V_r$, supplying said developer to said development roller, and collecting a residual developer; and a blade that comes into contact wit said development roller, and can form a uniform layer of said developer on said development roller, wherein said gap g between said development and said reset roller satisfies 0 mm<g≦0.4 mm.

2. A development device according to claim 1, wherein said offset voltage $V_{off}$ and peak-to-peak voltage $V_{p\text{-}p}$ applied to said development roller, and said DC voltage $V_r$ applied to said reset roller satisfy $|V_{off}|+V_{p\text{-}p}/2>|V_r|\geqq|V_{off}|$.

3. A development device according to claim 1, wherein said reset roller to which said DC voltage $V_r$ is applied includes a resistor inserted in series between a power supply generating said DC voltage $V_r$ and said reset roller, and said resistor includes a resistance between $10^6\Omega$ and $10^8\Omega$.

4. A development device according to claim 1, wherein said development roller is made of a material selected from a group consisting of metal and electrically conductive rubber having a specific resistance of $10^6\Omega\cdot$cm or less.

5. A development device according to claim 1, wherein said reset roller is made of a porous elastic member.

6. A development device according to claim 1, wherein said reset roller has a specific resistance ranging from $10^4\Omega$ to $10^7\Omega$.

7. A developer process comprising the steps of:

supplying a developer from a reset roller to which a DC voltage $V_r$ is applied, to a development roller to which a voltage having an AC waveform including an offset voltage $V_{off}$ and a peak-to-peak voltage $V_{p-p}$ is applied, by utilizing a potential difference between the reset roller and the development roller spaced apart from said reset roller by a gap g;

forming a uniform layer of said developer on said development roller by brining a blade into contact with said development roller;

flying said developer from said development roller spaced apart from a photosensitive body to said photosensitive drum so as to visualize images thereon; and collecting a residual developer remaining on said development roller utilizing the potential difference and said reset roller, wherein g, $V_r$, $V_{off}$, and $V_{p-p}$, satisfy 0 mm<g<0.4 mm, and $|V_{off}|+V_{p-p}/2>|V_r|\geqq V_{off}|$.

8. A development process according to claim 7, wherein said reset roller includes a resistor inserted in series between a power supply generating said DC voltage $V_r$ and said reset roller, and said resistor includes a resistance ranges from $10^6\Omega$ to $10^8\Omega$.

9. A development process according to claim 7, wherein said development roller is made of a material selected from a group consisting of metal and electrically conductive rubber having a specific resistance of $10^6\Omega\cdot$cm or less.

10. A development process according to claim 7, wherein said reset roller is made of a porous elastic member.

11. A development process according to claim 7, wherein said reset roller has a specific resistance ranging from $10^4\Omega$ to $10^7\Omega$.

12. A developer conveyance method comprising the steps of:

charging an uncharged developer with a DC voltage $V_r$ applied to a reset roller;

supplying said developer to a development roller which receives a voltage having an AC waveform including an offset voltage $V_{off}$ and a peak-to-peak voltage $V_{p-p}$, and is spaced apart from said reset roller by a gap g;

collecting said developer remaining on said development roller by using said reset roller, wherein a voltage applied to said development roller is $V_{p-p}/2+|V_{off}|-|V_r|$ in said supplying step, and $V_{p-p}/2-|V_{off}|+|V_r|$ in said collecting step.

13. A method according to claim 12, wherein said DC voltage $V_r$ applied to said reset roller, and said offset voltage $V_{off}$ and peak-to-peak voltage $V_{p-p}$ applied to said development roller satisfy $|V_{off}|+V_{p-p}/2>|V_r|\geqq|V_{off}|$.

14. An image-forming device comprising:

a photosensitive body;

a charger that charges said photosensitive body;

an exposure section that exposes said photosensitive drum charged by said charger, and forms an electrostatic latent image;

a development device that develops said exposed photosensitive drum, and visualizes said electrostatic latent image as a toner image; and a transfer section that transfers said toner image onto a recordable medium, wherein said development device comprises:

a development roller which receives a voltage having an AC waveform including an offset voltage $V_{off}$ and a peak-to-peak voltage $V_{p-p}$, and conveys a developer to a development area;

a reset roller spaced apart from said development roller at a gap g, said reset roller receiving a DC voltage $V_r$, supplying said developer to said development roller, and collecting a residual developer; and a blade that comes into contact with said development roller, and can form uniform layer of said developer on said development roller, wherein g, $V_r$, $V_{off}$, and $V_{p-p}$ satisfy 0 mm<g≦0.4 mm, and $|V_{off}|+V_{p-p}/2>|V_1|V_{off}|$.

15. An image-forming device according to claim 14, wherein said reset roller includes a resistor inserted in series between a power supply generating said DC voltage $V_r$ and said reset roller, and said resistor includes a resistance ranges from $10^6\Omega$ to $10^8\Omega$.

16. An image-forming device according to claim 14, wherein said development roller is made of a material selected from a group consisting of metal and electrically conductive rubber having a specific resistance of $10_6$ U·cm or less.

17. An image-forming device according to claim 14, wherein said reset roller is made of a porous elastic member.

18. An image-forming device according to claim 14, wherein said reset roller has a specific resistance ranging from $10^4\Omega$ to $10^7\Omega$.

* * * * *